United States Patent [19]

Dhingra

[11] 4,036,599

[45] July 19, 1977

[54] POLYCRYSTALLINE ALUMINA FIBERS AS REINFORCEMENT IN MAGNESIUM MATRIX

[75] Inventor: Ashok Kumar Dhingra, Wilmington, Del.

[73] Assignee: E. I. Du Pont de Nemours and Company, Wilmington, Del.

[21] Appl. No.: 604,933

[22] Filed: Aug. 15, 1975

Related U.S. Application Data

[63] Continuation-in-part of Ser. No. 378,624, July 12, 1973, abandoned.

[51] Int. Cl.[2] ..... B32B 5/00; B32B 15/14

[52] U.S. Cl. ..... 428/608; 428/925

[58] Field of Search ..... 29/180 R, 183.5, 191.2, 29/191.4, 191.6, 195 M

[56] References Cited

U.S. PATENT DOCUMENTS

| | | | |
|---|---|---|---|
| 3,098,723 | 7/1963 | Micks | 29/183.5 |
| 3,297,415 | 1/1967 | Allen | 29/191.6 |
| 3,353,932 | 11/1967 | Shanley | 29/182.2 |
| 3,876,389 | 4/1975 | Chaudhari et al. | 29/191.2 |

*Primary Examiner*—L. Dewayne Rutledge
*Assistant Examiner*—E. L. Weise

[57] ABSTRACT

A fiber reinforced metal composite comprising magnesium or a magnesium alloy containing substantially aligned, polycrystalline alumina fibers which have certain surface roughness characteristics and contain at least 80% $Al_2O_3$ by weight.

2 Claims, No Drawings

POLYCRYSTALLINE ALUMINA FIBERS AS REINFORCEMENT IN MAGNESIUM MATRIX

CROSS REFERENCE TO RELATED APPLICATION

This application is a continuation-in-part of copending application Ser. No. 378,624, filed July 12, 1973, now abandoned.

FIELD OF THE INVENTION

This invention relates to reinforced composites comprising metals reinforced with inorganic fibers. More specifically, the invention is directed to a composite of magnesium or a magnesium alloy reinforced with polycrystalline alumina refractory oxide fibers.

BACKGROUND

Much effort has been made to reinforce metals with fibers that are sufficiently refractory to withstand the temperatures needed to make and use such composites.

Ceramic, or refractory oxide, fibers in the form of whiskers have been suggested as a means of enhancing the high temperature strength of metals. However, composites containing the desired high volume of aligned and uniformly distrubuted whiskers in the metal matrix have not been obtained because the small single crystalline whiskers are difficult to handle.

The use of continuous fibers would alleviate the problems encountered with short fibers but it has been difficult to prevent breakage of such fibers and damage to their surfaces. Such breakage and surface damage weaken the reinforcement capabilities of continuous fibers. In addition, the common continuous filament refractory fibers, carbon fibers and boron fibers oxidize at elevated temperatures, causing a decrease in their strengthening capabilities.

Long fibers of single crystal alumina are known. However, due to the large diameters (about 10 mils) of these fibers and their smooth surfaces, they pull out and separate causing the composite to fail in use and during machining.

Moreover, many combinations of fibers and metals give poor composites due to excessive reaction between the fiber and the metal which causes the formation of a brittle phase and deterioration of properties.

In addition, the bonding between the metal and the fibers necessary for strength of composites made heretofore has been found to deteriorate generally on heating of the composite, resulting in a significant loss of properties. This may be due, in the instance of infiltration of fibers by molten metal, to the inability of the molten metal to wet the fibers sufficiently to cause good bonding between them or to excessive fiber-metal reaction.

It is an object of this invention to provide a metal composite that substantially obviates the above problems.

SUMMARY OF THE INVENTION

This invention provides a fiber reinforced metal composite consisting essentially of A. substantially aligned, continuous, polycyrstalline alumina fibers containing at least about 80 percent $Al_2O_3$ by weight, and having
   1. a diameter of between about 10–150 $\mu$,
   2. a microscopic roughness height between about 0.1 and 0.7 $\mu$, 3. a microscopic roughness period between about 0.4 and 1.5$\mu$, and
   4. a tensile strength of at least about 125,000 psi after removal from the composite, said fibers comprising between about 30 and 80 percent of the composite by volume; and B. a matrix of magnesium or a magnesium alloy containing at least about 70 percent magnesium by weight and having an average grain size in the composite of less than about 10$\mu$.

Preferably the above composite will be enclosed in a metallic sheath such as stainless steel or titanium. The thickness of the sheath will be from about 5 to 25 percent of the diameter of the unsheathed composite.

DESCRIPTION

The Composites of the Invention

The composites of this invention inherently possess a Youngs modulus of at least $15 \times 10^6$ psi at room temperature (e.g., about 21° C.) and the retention of a substantial fraction (at least about 85%) of that modulus at elevated temperatures. The composites generally have a tensile strength in excess of $30 \times 10^3$ psi, and a flexural strength about $60 \times 10^3$ psi which are both substantially retained at elevated temperatures. The Youngs modulus can range up to $40 \times 10^6$ psi or more.

The composites contain between about 30 and about 80 volume percent fibers. The density of the composites may range from between about 0.086 and about 0.133 lbs./in.$^3$. Composites containing about 50 volume percent fiber have a density of about 0.105 lb./in.$^3$, which is about equivalent to aluminum. However, the Youngs modulus of aluminum is only about $10 \times 10^6$ psi at room temperature, and decreases to $4.4 \times 10^6$ at 315° C.; thus the composites of this invention are superior to aluminum, especially for use in high temperature applications.

Preferred composites contain at least 50 volume percent of fibers having a diameter of between about 15 and 30$\mu$ and a tensile strength of at least $200 \times 10^3$ psi. Such preferred composites have a Youngs modulus of at least $25 \times 10^6$ psi, a tensile strength of at least $60 \times 10^3$ psi and a longitudinal flexural strength in excess of $125 \times 10^3$ psi.

The composites are readily machined with conventional machine tools. In contrast, many metal-fiber composites of the prior art tend to delaminate upon such treatment.

The properties of the composites are considered to be due, in part, to the excellent "bonding" which is believed to take place between the metal matrix and the small diameter rough surface fibers employed. The effect of this "bonding" is readily seen in scanning electron micrographs of fracture surfaces of the composites. A small amount of chemical reaction between the fibers and the metal is believed to occur resulting in a reaction zone at the interface that is less than about 2 microns thick. Chemical reaction is deduced from the fact that the fibers do not pull out of the matrix and that the properties of the composite are retained at elevated temperature. This reaction is not considered excessive and does not cause loss of fiber strength.

Composites which have a stainless steel sheath are particularly useful since both sheath and composites have a similar modulus and coefficient of expansion (about $10 \times 10^{-6}$° C.$^{-1}$ at room temperature). The composites which bear a metallic sheath can be mechanically worked and the sheath then removed if desired. Sheathed composites can be reduced by as much as 85 percent in thickness by forging near the melting point of the metal and still yield products having about 95 percent of the strength of the originals. In addition to forging, such metal-sheathed composites can be rolled, extruded, swaged, drawn, hydrostatically extruded, or hot isostatically pressed. It is believed that this unusual behavior is due at least in part to the small grain size of the metal matrix in the composites which contributes to their ductility. It is also believed that the small grain size will result in superior transverse and shear properties of the composites. The average grain size is less than about 10 $\mu$, preferably less than about 4 $\mu$. Substantially all the grains are smaller than about 17 $\mu$. The composites of this invention can be used in the construction of pipes, shafts, springs, turbine blades, structural beams, cones and a wide variety of other structures.

THE PREPARATION OF THE COMPOSITES

The Fibers

The continuous polycrystalline alumina fibers employed herein are high modulus, high strength fibers containing at least about 80 percent $Al_2O_3$ by weight, preferably at least about 90 percent $Al_2O_3$, and most preferably substantially all $Al_2O_3$. By the term "continuous" is meant that the fibers in the composite have a length about as long as that of the composite as measured in the direction in which the fibers are aligned. The fibers may be aligned parallel, perpendicular or at any other angle with respect to any axis in the composite. It is understood that the fibers in a worked composite may be as short as the critical length as defined in Example 6.

Preferably also, the $Al_2O_3$ is predominantly in the form of alpha alumina, and most preferably substantially all is alpha alumina. The tensile strength of the fibers is at least about 125,000 lbs./in.$^2$(psi) and is preferably at least about 200,000 psi. It has been found that the alumina fibers are not degraded when they are used in the fabrication of the composites of this invention. Thus, the alumina fibers substantially retain their original properties such as tensile strength. This can be determined easily by measuring the tensile strength of the fibers after removal from the composite. The alumina fibers can be leached out of the composite by dissolving away the metal matrix in 20% aqueous hydrochloric acid. After the alumina fibers are washed, for example with running water, they can be dried in an oven at 100° C. and their tensile strength can be determined. Generally, any variance in tensile strength is due to experimental error (± 10,000 psi) and the brittleness of the alumina fibers per se. The tensile strength may be as high as about 350,000 psi. The Youngs modulus of the fibers is at least about $45 \times 10^6$ psi and is preferably at least $50 \times 10^6$. It can be as high as $75 \times 10^6$ or more. The preparation of these fibers is known in the art, being described in U.S. Pat. No. 3,853,688 and 3,808,015 issued Dec. 10, 1974 and Apr. 4, 1974, respectively, to D'Ambrosio and Seufert, respectively. The fibers have a diameter of between 10 and about 150 microns, preferably 15 to 30 microns. The fibers can be coated with a film of about 0.01 to about 1 micron thickness of silica to impart still greater strength to them. In addition to $Al_2O_3$, the fibers can contain refractory oxides and systems such as $SiO_2$, MgO, $ThO_2$, $ZrO_2$, $ZrO_2$-CaO, $ZrO_2$-MgO, $ZrO_2SiO_2$, $Cr_2O_3$, $Fe_2O_3$, NiO, CoO, $Ce_2O_3$, $HfO_2$, $TiO_2$, and the like. These fibers should have a melting point of at least 1000° C. Preferably, the fibers will be employed in the form of yarns containing 50 or more of the continuous filament alumina-containing refractory oxide fibers.

Because of the high temperature stability of these fibers, they are more suited for use with molten metal in the fabrication of composites than are boron or graphite fibers known in the art. In addition, because of their small diameter, these fibers lend themselves to fabrication of composites of more complex shapes than can be made with many art-described inorganic continuous filaments.

The fibers should have a rough surface, i.e., have small protrusions or bumps on the surface characterized by a microscopic roughness height of between about 0.1 and 0.7 $\mu$, preferably 0.20 and 0.40 $\mu$, and a microscopic roughness period between about 0.4 and 1.5 $\mu$, preferably 0.80 and 1.5 $\mu$. It is believed that the protrusions provide capillary spaces between "contacting" fibers for better infiltration and assist in mechanically bonding the fibers to the magnesium.

The Metals

Any type of magnesium metal or magnesium alloy containing at least 70 percent, preferably at least 90 percent, by weight of magnesium can be used as the matrix metal in the composites of this invention. Since magnesium can be alloyed with only a limited number of metals, the variety of metal matrices which can be used in the composites of this invention is similarly limited. In addition to magnesium metal, alloys containing at least 70 percent by weight of magnesium with aluminum, manganese, zinc, thorium, rhenium, zirconium, calcium or mixtures thereof can be used. Alloys with zinc, aluminum and manganese or mixtures thereof are preferred.

The Preparation

The composites are conveniently made by loading a suitable mold with about 30 to 80 volume percent of aligned polycrystalline alumina fibers, separating the fibers and uniformly distributing the fibers in the mold, heating the mold (and fibers) to within about ± 75° C. of the melting point of the metal, infiltrating the fibers with molten metal by forcing the molten metal into the mold by applying pressure and cooling the mold. Preferred composite preparations are disclosed in U.S. Pat. No. 3,828,839 issued Aug. 13, 1974 to Dhingra.

By using a suitable eutectic magnesium alloy as the metal matrix, the composites after liquid infiltration may be unidirectionally solidified in a direction perpendicular to the fiber axis, thereby growing a second phase (generally an intermetallic compound) in the matrix in the form of whiskers, platelets of fibers aligned perpendicular to the alumina fibers. This should in effect result in transverse reinforcement and significantly improve the transverse and shear properties of the composites.

TEST PROCEDURES

Fiber Tensile Properties

Tensile strengths are measured at ambient room conditions (25° C.) using a method by R. D. Schile et al. in "Review of Scientific Instruments", 38 No. 8, August 1967, pp. 1103–4. The gauge length is 0.04 inch (0.1 cm.) and the crosshead speed is 1–4 mils/min.

Youngs moduli of the fiber are measured by vibroscope techniques as described in J. Applied Physics, Vol. 26, No. 7, 786, 792, July, 1955.

Fiber Roughness

The microscopic roughness height and period is obtained by measuring the height and spacing, relative to the adjacent fiber surface, of protrusions observed on a magnified silhouette of the longitudinal filament surface. The fibers are placed on copper grids using standard electron microscope procedures for viewing solid objects in transmission and photographed at 1500× or 2500× magnification. The silhouettes are then enlarged photographically to a final magnification of 6000×. A straight edge is laid along the edge of a representative portion of the fiber surface, i.e., ignoring occasional atypical protuberances, which may be due to dirt, in the micrograph so that a fiber surface image equivalent to a 9 micron ($\mu$) length of the fiber (i.e., 54 mm at 6000×) lies adjacent the straight edge.

To obtain roughness period, the number of peaks which are at least 0.05 $\mu$ high in the 9 $\mu$ eqiuvalent length are counted and this procedure is repeated for three separate typical sections. The values obtained are converted to roughness period expressed as the average distance in $\mu$ between peaks for the three samples. To obtain microscopic roughness height, a straight edge is placed on the same micrograph used to determine roughness period so that it just touches the two tallest peaks on a 5 $\mu$ length of the fiber. The maximum distance from the straight edge to the deepest valley in this section is measured. This is repeated three times on separate typical sections. The three numbers are averaged arithmetically and the average, expressed in $\mu$, is the microscopic roughness height.

Microstructural Features

The microstructural features of the composites of this invention and their components, such as diameter of fibers, coating thickness, component distribution, and metal matrix grain size are determined microscopically. Sections are cut from the structure and suitably embedded in an organic resin for handleability during a polishing procedure to prepare the section for microscopic examination. After it is properly polished, the specimen is examined via reflected light microscopy or Scanning Electron Microscopy. Scanning Electron Microscopy requires the deposition of a metallic film onto the surface of the sample to be examined to ensure electrical continuity during the scanning. The average grain size of the metal matrix is determined microscopically using transverse or longitudinal sections and lineal analysis, as generally described in "Ceramic Microstructure" edited by Fulrath and Pask, published by John Wiley and Sons, Inc., New York 1968, especially pages 187–207 and 25–53. Nondispersive X-ray spectrometry in the Scanning Electron Microscope can be used in some cases to determine reactions between fibers and metal by performing elemental profiles. These techniques are generally described in *Energy Dispersion X-ray Analysis: X-ray and Electron Probe Analysis,* A.S.T.M., Special Technical Publication, 485, 1970, especially pages 154–180.

The flexural strengths and the Youngs moduli of both composites and sheathed composites are determined by the standard three-point flexural testing method using a crosshead speed of 0.05 inch/minute on an Instron Testing machine with an oven (ASTM D 790–66 using the tangent modulus).

The tensile strengths (as well as the Youngs moduli) of the composites are determined on cylindrical dumbbell samples in an Instron Universal Testing Machine at a crosshead speed of 0.05 inch per minute.

EXAMPLE 1

The fibers used are polycrystalline alumina fibers (about 99% $Al_2O_3$ substantially all as alpha alumina) with diameters ranging from about 15 to 25 microns in the form of a 60 filament yarn. In general, the fibers have a microscopic roughness height of from about 0.2 to about 0.4 micron and a roughness period of from about 0.8 to about 1.5 micron, and a tensile strength of about 200,000 psi.

To make a five inch long composite, five inch lengths of the above yarn are uniaxially packed into a Type 316 stainless steel tube (0.18 inch I.D. × 0.25 inch O.D.) to a fiber loading of 50 volume percent. The fibers in the tube are rinsed with acetone and then dried in an oven at 200° C. for 1 to 2 hours. The tube and fibers are placed against a vertical rod-type vibrator (Type EI made by A. G. Fuer Chemie-Apparabebau, Zurich) to separate the fibers and uniformly distribute them inside the tube. The tube and fibers are heated in a flame to within about 75° C. of the melting point of magnesium and one end of the tube placed below the surface of a melt of commercially pure (99.7%) magnesium at about 750° to 767° C. Vacuum is applied to the tube so that the magnesium completely infiltrates the fibers and then solidifies. The tube is removed from the magnesium bath and cooled. Flux and magnesium adhering to the outer surface of the tube are removed by machining.

The samples are machined to a dog-bone shape with a central cylindrical portion of composite of 0.14 inch diameter × 1.5 inch length which expands at each end over a 0.375 inch length to a 0.25 inch diameter (with metal sheath) which diameter is continued for a length of 0.75 inch at each end.

Samples are broken under tension at different temperatures and fibers are recovered from some of the broken pieces by dissolving the metal in 20% aqueous HCl, washing and then drying the fibers in an oven at 100° C. Composite properties and recovered fiber properties are given in Table 1 as items a, b and c.

TABLE 1

| | Test | Composite Properties | | Fiber Properties | | | |
|---|---|---|---|---|---|---|---|
| | Temp. | Tensile | Youngs | Roughness | Roughness | Tensile Strength psi | |
| Item | °C. (approx.) | Strength psi | Modulus psi | Height $\mu$ | Period $\mu$ | Initial | Recovered |
| a | 21 | 77,000 | $30 \times 10^6$ | 0.28 | 0.85 | 217,000 | 204,000 |
| b | 315 | 72,000 | $30 \times 10^6$ | 0.23 | 0.85 | 217,000 | 218,000 |
| c | 426 | 63,000 | $30 \times 10^6$ | 0.30 | 1.43 | 217,000 | 207,000 |

The grain size of the magnesium matrix as measured at 21° C. and before the temperature is raised to the test temperature is about 3 microns for these samples.

EXAMPLE 2

A. Composites containing about 50 volume percent of fibers described as in Example 1 in commercially pure magnesium are prepared using the technique of Example 1 with a quartz tube (about 0.12 to 0.2 inches I.D.) as a mold and infiltration at about 700° C. The quartz breaks upon cooling the composite and its remnants are removed and the composite machined to about 1/8 inch diameter x 3.5 inch length. Flexural strength and moduli are determined at room temperature on three samples (average used for Item a of Table 2A) and at about 426° C. on two samples (with the average results of the two samples given as Item b in Table 2A). One sample (a) used for flexural strength is cut in half and 1 part (a-1) heated for 8 hours at 315° C. and the other part (a-2) heated for 1 hour at 600° C. before recovering the fibers as described in Example 1 and measuring their properties which are reported in Table 2A.

TABLE 2A

| Item | Test. Temp. ° C. (approx.) | Flexural Strength psi | Youngs Modulus psi | Fiber Properties: Roughness Height μ | Roughness Period μ | Tensile Strength psi | Diameter μ |
|---|---|---|---|---|---|---|---|
| a | 21 | 101,000 | $31 \times 10^6$ | | | | |
| a-1 | | | | 0.3 | 0.88 | $264 \times 10^3$ | 21.2 |
| a-2 | | | | 0.38 | 1.13 | $275 \times 10^3$ | 16.5 |
| b | 426 | 127,000 | $30 \times 10^6$ | | | | |

The grain size of the magnesium matrix as measured at 21° C. and before the temperature is raised to the test temperature is about 3 microns for these samples.

B. The procedure of part A is repeated using polycrystalline alumina fibers (containing at least 95% $Al_2O_3$ substantially all as alpha alumina) with a coating of silica less than about 0.5 micron thick. The fibers have diameters ranging from 15 to 25 microns and have a nominal tensile strength of about $275 \times 10^3$ psi. The continuous fibers are used in the form of a 60 filament yarn.

Flexural strength and moduli are determined on machined samples of about ⅛ inch diameter at room temperature (Item c — the average of three samples), at 315° C. (Item d — the average of two samples) and at 426° C. (Item e).

One Item c sample used for flexural strength is cut in half and 1 part (Item c-1 heated for 8 hours at 315° C. and the other part (Item c-2) heated for 1 hour at 600° C. before recovering the fibers as described in Example 1 and measuring their properties. The results are reported in Table 2B.

TABLE 2B

| Item | Test Temp. ° C. (approx.) | Composite Properties: Flexural Strength psi | Youngs Modulus psi | Fiber Properties: Roughness Height μ | Roughness Period μ | Tensile Strength psi | Diameter μ |
|---|---|---|---|---|---|---|---|
| c | 21 | $145 \times 10^3$ | $34 \times 10^6$ | | | | |
| c-1 | | | | 0.21 | 1.04 | $264 \times 10^3$ | 17.6 |
| c-2 | | | | 0.18 | 1.30 | $298 \times 10^3$ | 16.8 |
| d | 315 | $140 \times 10^3$ | $31 \times 10^6$ | | | | |
| e | 426 | $136 \times 10^3$ | $29 \times 10^6$ | | | | |

The grain size of the magnesium matrix as measured at 21° C. and before the temperature is raised to the test temperature is about 5.5 microns for these samples.

EXAMPLE 3

This example shows the small grain size of the metal in composites of this invention prepared as described in Example 1.

Composites of the invention (Items a, b, c and d in Table 3) are made containing about 50 volume percent of the uncoated alumina fibers of Example 1 (labelled Fiber I in Table 3) and the silica coated alumina fibers of Example 2B (labelled Fiber II in Table 3) with commercially pure magnesium (Mg) or magnesium alloy (AZ31 containing 3% Al, 1% Zn and 1/2% Mn).

For comparison, composites (Items f and g in Table 3) are made using single crystal alumina fibers of about 240 micron diameters (labelled Fiber III in Table 3). Commercially pure magnesium and AZ31 are cast into separate quartz tubes without any fibers in them to make comparisons (Items e and h of Table 3). A temperature of about 750° C. is used to prepare all samples except Item a (767° C.). Quartz tubes of about ⅛ inch I.D. are used as molds for Items e and f, stainless steel tubes of ¼ inch I.D. are used for Items b, c and d and ⅛ I.D. stainless steel tubes are used for Items a and g.

The grain sizes of the metal matrix are determined and given below in Table 3.

TABLE 3

| Item | Fiber | Metal | Avg. Grain Size Microns |
|---|---|---|---|
| a | I | Mg | 3 |
| b | II | Mg | 5.5 |
| c | I | AZ31 | 2.1 |
| d | II | AZ31 | 2.1 |
| e | None | Mg | 70 |
| f | III | Mg | 30 |
| g | III | AZ31 | 31 |
| h | None | AZ31 | 25 |

EXAMPLE 4

This example shows the fabrication of a composite billet which is particularly suitable for mechanical working operations such as extrusion, rolling, forging, and the like.

The fibers used are polycrystalline alumina fibers of about 20 microns in diameter.

An initial preform of fibers and polymer is made as described in Example I of U.S. Pat. No. 3,828,839. The preform is ¼ inch thick, 6 inches wide, weighs 1175 gms. and contains 50 volume percent loading of fibers in the preform. The preform is rolled in a spiral form along the axis of the fibers and packed in a cylindrical stainless steel mold, 3 inches I.D., 3-⅛ inches O.D. and 6 inches long. The organic binder is then burned off by heating the mold in a tube furnace at 600° C. The small end of the mold is connected to vacuum so as to remove burnt polymer from the fibers. The fibers are white after complete removal of the binder.

A graphite distribution plate 3 inches D × ½ inch thick containing 90, ⅛ inch equally spaced holes is fitted to the open end of the mold using a ceramic cement. The mold is then preheated to about 700° C. in a tube furnace and infiltrated with molten magnesium at 750° C. using a vacuum of about 150 mm of Hg.

The billet is then allowed to cool in a vertical position to room temperature.

The dimensions of the finished billet are 3 inches in diameter × 5 inches in length with stainless steel cladding about 1/16 inch thick. The volume fraction of fibers in the billet is 50 percent. A polished cross-section of the billet shows a distinct spiral configuration; the alternate layers of fibers are separated by layers of matrix.

In order to obtain good adhesion between mold and composite, the inside of the mold can be abraded, etched or coated with a compatible alloy such as a brazing alloy. Thus, products made in metal molds such as stainless steel or titanium can be used as molded, e.g., as a turbine blade which requires high impact strength. The sheathed composites can be mechanically worked and the sheath then removed if desired. The fibers display a surprising resistance to breakage so that reductions in the thickness of alumina fiber/magnesium composite by as much as 85% (by forging near the melting point of the magnesium) still yield products having about 95% of the strength of the originals.

The metal clad composites can be forged, rolled, extruded, swaged, drawn, hydrostatically extruded, or hot isostatically pressed; the latter two being preferred. For ease of workability, such operations are preferably conducted at a temperature at which part of the metal is in a liquid phase but with sufficient solid metal present to prevent misalignment and breakage of the fibers.

The use of hydrostatic extrusion techniques as described in *Product Engineering*, Feb. 1973, pages 27 to 30, would be a particularly useful means to form shaped products from billets of composites of this invention and composites of the type shown herein. Such composites would preferably be sheathed with a metal but unsheathed composites could be used.

EXAMPLE 5

This example shows the preparation of a metal sheathed composite and mechanical working of the composite.

The fibers of Example 1 are used. Five inch lengths of a yarn containing 60 fibers are uniaxially packed into a Type 316 stainless steel tube (0.25 inch O.D. × 0.1875 inch I.D.) to give a fiber loading of about 55 vol. percent. The fibers in the tube are rinsed with acetone and then dried in an oven at 200° C. for 1 to 2 hours. The tube and fibers are placed on a vertical rodtype vibrator of Example 1 to separate the fibers and uniformly distribute them inside the tube. The tube and fibers are heated in a flame and one end of the tube placed below the surface of a melt of commercially pure magnesium (99.7%) at 740° -760° C. Vacuum is applied to the tube so that the magnesium completely infiltrates the fibers and solidifies. The tube is removed from the magnesium bath and cooled. Flux and magnesium adhering to outer surface of the tube are removed by machining.

Four inch lengths of the metal clad composites are heated in a furnace in argon atmosphere, removed and forged flat using a 500 lb. mechanical hammer with steel shims to control the thickness of the forged composite. Three samples in Table 4 are so forged (Items b, c, and d), while one sample (Item e) is rolled in a conventional rolling mill. Item a is a control.

The flexural properties of the clad composites are determined and are described in Table 4. Table 4 also shows the temperature of the sample as removed from the furnace, the reduction in thickness of the fiber/magnesium core, the average length in mils of the fibers after the operation and flexural properties of the mechanically worked specimen.

TABLE 4

| Item | Operation | Temperature °C. | Reduction % | Fibers Avg. Length mils | Flexural Strength psi | Flexural Modulus psi |
|---|---|---|---|---|---|---|
| a | none (control) | — | 0 | 500 | $125 \times 10^3$ | $24 \times 10^6$ |
| b | forging | 643 | 47 | 500 | $132 \times 10^3$ | $21 \times 10^6$ |
| c | forging | 638 | 70 | 84 | $134 \times 10^3$ | — |
| d | forging | 538 | 85 | 55 | $135 \times 10^3$ | $23 \times 10^6$ |
| e | rolling | 599 | 82 | 7.5 | $140 \times 10^3$ | $18 \times 10^6$ |

The fiber lengths in the resulting worked composites of Table 4 are determined by dissolving the steel sheath and magnesium matrix in a 0.5 inch sample in 20% HCl, washing the fibers with water, drying, dispersing in acetone, spreading on a slide, photographing at 200X and measuring. Other samples are determined from metallographically polished sections mounted in plastic.

The critical length (lc) of a fiber in a conposite is defined as the length of a fiber necessary to pick up (in a composite) 97% of the stress of a similar fiber of infinite length and is calculated by the equation $$lc = d\delta E_F/2T$$

where d is the fiber diameter in inches, $\delta_F$ is the fiber fracture stress in psi and T is the shear (flow) strength in psi of the matrix (2000 psi for commercially pure magnesium). For the fibers in the composites of this example, lc is 35 mils.

It is very surprising that no fibers are broken when the core is reduced 47% by forging at a temperature near the melting point of the magnesium when the matrix is in a slushy state (shown in item b of Table 4). It is observed that even an 85% reduction at 538° C. by forging (item d of Table 4) still yields fibers longer than length lc (i.e., long enough to pick up 97% of the stress of a similar fiber of infinite length). Thus, by these forging methods, reductions in thickness of fiber/magnesium cores of up to 85 percent may be obtained with no appreciable loss in flexural strength or modulus. It is estimated that reductions of up to 55% by rolling would yield fibers longer than length lc.

Similar results are obtained by multistage forging and rolling with reheating between stages.

Improved results would be obtained by cooling the ends of the sheathed composite so that the solid matrix metal serves as a plug for the interior slushy metal. The use of magnesium alloys with a longer range of liquid to solid temperatures would afford easier processing.

The foregoing detailed description has been given for clearness of understanding only and no unnecessary limitations are to be understood therefrom. The invention is not limited to the exact details shown and described for obvious modifications will occur to those skilled in the art.

The embodiments of the invention in which an exclusive property or privilege is claimed are defined as follows:

1. A fiber-reinforced metal composite consisting essentially of

A. substantially aligned, continuous, polycrystalline alumina fibers which are substantially all alpha alumina and have 1. a diameter of about 15 to 30 microns,
2. a microscopic roughness height between 0.20 and 0.40 micron,
3. a microscopic roughness period between 0.8 and 1.5 micron, and
4. a tensile strength of at least about 125,000 pounds per square inch after removal from the composite, said fibers comprising between about 50 and 80 percent of the composite by volume; and B. a matrix of magnesium or magnesium alloy containing at least 90 percent magnesium by weight and having an average grain size in the composite of less than about 4 microns.

2. The composite of claim 1 enclosed in a metallic sheath having a thickness between about 5 and 25 percent of the diameter of the unsheathed composite.

* * * * *